United States Patent [19]

Hager

[11] Patent Number: 5,033,614

[45] Date of Patent: Jul. 23, 1991

[54] CUE STICK SECTION STRAIGHTENER AND PROTECTOR

[76] Inventor: John W. Hager, 3556 Royal La., Dallas, Tex. 75220

[21] Appl. No.: 535,709

[22] Filed: Jun. 11, 1990

[51] Int. Cl.[5] ..... B65D 81/08

[52] U.S. Cl. ..... 206/315.1; 206/591; 273/68

[58] Field of Search ..... 206/315.1, 591, 592, 206/594; 273/68–71

[56] References Cited

U.S. PATENT DOCUMENTS

| | | | |
|---|---|---|---|
| 3,669,256 | 6/1972 | Jacob | 206/591 |
| 3,830,362 | 8/1974 | Tassone et al. | 206/315.1 |
| 4,402,355 | 9/1983 | Wymore et al. | 206/315.1 |

*Primary Examiner*—William I. Price

*Attorney, Agent, or Firm*—Warren H. Kintzinger

[57] ABSTRACT

Resilient material elongate cloth strips are inserted into a tubular cue stick section enclosing, supporting and protecting tube with the elongate cloth strips folded over the smaller diameter end of the cue stick section for initial insertion into the enclosing protective tube. Adhesive is used within both ends of the tube to hold the cloth in place when inserted therein along with a tube end plug and a decorative liner within the tube through a substantial length thereof. The larger, or butt end, of the cue stick section extends outward to the exterior of the tube within which the cue stick is a snug holding fit. Two, and in some instances three, cloth strips are used to give adequate resilient cushioning support to the smaller end of the cue stick section and single layer resilient cushioning support toward the larger end of the cue stick section. A typical cloth well suited for this use with the desired resilient compressability factor is various wool felt fabrics.

12 Claims, 1 Drawing Sheet

CUE STICK SECTION STRAIGHTENER AND PROTECTOR

Figure 1:
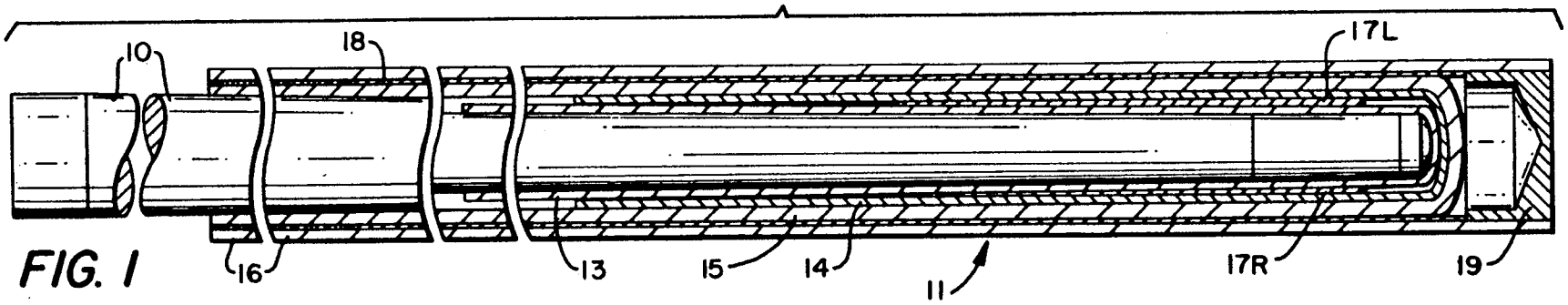

This invention relates in general to pool cue stick protective enclosures, and more particularly, to a cue stick straightener and protective tubular holders sized for the different sections of a cue stick.

Through the years many pool cue stick protective cases and enclosures have been used. Some of these are in the form of tubular structures with spaced doughnut elements sized to fit various diameters of a cue stick section and lend support thereto from the tubular container for a specific cue stick section. These do not give resilient cushioned support over an extended length of a cue stick section so supported for protection and to keep a cue stick section straight.

It is therefore a principal object of this invention to provide for resilient cushioned support for a cue stick section within a cue stick section holder.

Another object is to provide a tight snug fit for a pool cue stick section with resiliently compressible cloth within a tubular container between the container and the cue stick section.

A further object is to provide pool cue stick section resiliently compressible cloth support through substantially the length of the cue stick section being inserted into a tubular cue stick carrier and protector.

Features of the invention useful in accomplishing the above objects include, in a cue stick section straightner and protective tubular holder, resilient material elongate cloth strips are inserted into a tubular cue stick section enclosing, supporting and protecting tube with the elongate cloth strips folded over the smaller diameter end of the cue stick section for initial insertion into the protective tube. Adhesive is used within both ends of the tube to hold the cloth in place when inserted therein along with a tube end plug and a decorative liner within the tube through a substantial length thereof. The larger, or butt end, of the cue stick section extends outward to the exterior of the tube within which the cue stick is a snug holding fit. Two, and in some instances three, cloth strips are used to give adequate resilient cushioning support to the smaller end of the cue stick section and single layer resilient cushioning support toward the larger end of the cue stick section. A typical cloth well suited for this use with the desired resilient compressability is various wool felt fabrics.

A specific embodiment representing what is presently regarded as the best mode of carrying out the invention is illustrated in the accompanying drawing.

In the Drawing

Figure 2:
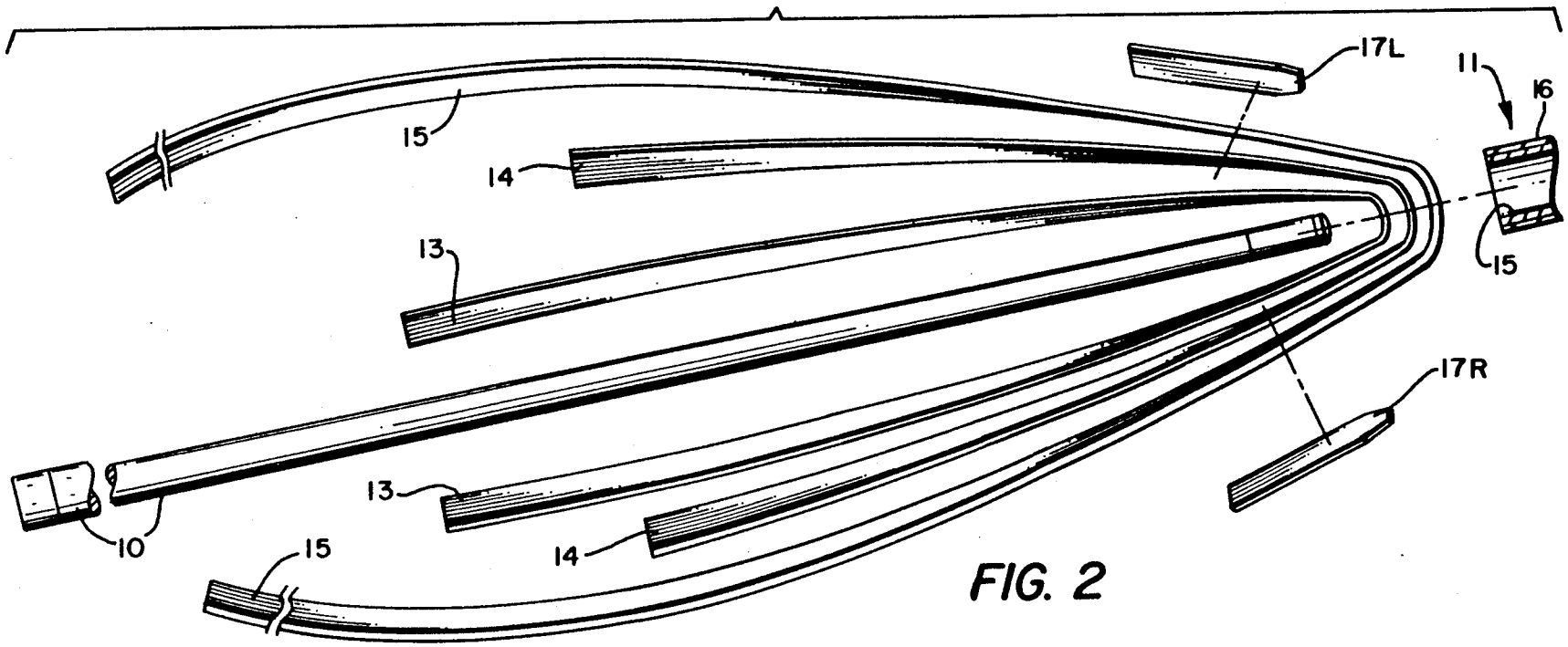

FIG. 1 represents a cut away and sectioned view of a cue stick section straightener and protector; and FIG. 2, a partial unassembled perspective view of the cue stick section, resiliently compressible cloth strips and the protection holder tube in the pre-assembled state.

Referring to the Drawing

The cue stick section 10 straightener and protective tube holder 11 has resiliently compressible cloth material in the form of elongate strips 13, 14 and 15 insertable into a tube 16 by the cue stick section 10 to be held in the holder 11. Relatively short cloth strip lengths 17L and 17R of cloth material are used to fill out space along with the longer strips 13, 14 and 15 filling out space between the cue stick section 10 and the tube 16. The longer strips 13, 14, and 15 that are of different lengths to accomodate taper of the cue stick section 10 and short filler length cloth strips such as lengths 17L and 17R are advantageously made of a resiliently compressible fabric such as wool felt fabric cloth strips to give the desired resilient support to the cue stick section 10 held within the protective tube holder 11.

A length of relatively stiff paper 18 with an outer facing artistic design or color is bent to cylindrical shape and inserted within the transparent tube 16 extending from insert plug 19 (a plastic front end protective closure plug 19, either a press fit in the tube holder 11 or held in place with adhesive) toward the tube end but spaced therefrom. Adhesive is applied to the inside front of paper 18 to fix the front end of fabric strip 15 in place within the holder tube 16. Adhesive is also applied to the inside rear of tube 16 to hold rear ends of the outer fabric strip 15 in place at the back end of the holder tube 16.

The cue stick section instead of being the forward cue stick section 10 could be the rear tapered butt section of a pool cue stick with the tube being larger but with all other features substantially the same. It should be noted that a tube made of strong, hard plastic is very strong and rigid from a structural standpoint with tubes being one of the strongest structural shapes known.

Whereas this invention has been described with respect to a specific embodiment thereof, it should be realized that various changes may be made without departure from the essential contributions to the art made by the teachings hereof.

I claim:

1. A pool cue stick section straightener and protective holder comprising: a tube sized to contain most of the length of a pool cue stick section and resiliently compressible material supporting the cue stick section within the tube; and with said resiliently compressible material including a plurality of different length resiliently compressible cloth strips.

2. The pool cue stick section straightener and protective holder of claim 1, wherein cloth segments are also included as space fill out between cloth strips of said plurality of different length resiliently compressible cloth strips.

3. The pool cue stick section straightener and protective holder of claim 1, wherein said cloth segments are resiliently compressible cloth material segments.

4. The pool cue stick section straightener and protective holder of claim 2, wherein said plurality of different length resiliently compressible cloth strips are wool felt cloth strips.

5. The pool cue stick section straightener and protective holder of claim 4, wherein said plurality of different length resiliently compressible cloth strips are strips of various thickness.

6. The pool cue stick section straightener and protective holder of claim 5, wherein a length of relatively stiff material with an attractive outer surface is bent to cylindrical shape placed within said tube; and with said tube a transparent plastic tube.

7. The pool cue stick section straightener and protective holder of claim 1, wherein a length of relatively stiff material with an attractive outer surface is bent to cylindrical shape placed within said tube; and with said tube a transparent tube.

8. The pool cue stick section straightener and protective holder of claim 6, wherein an insert plug closes the forward end of said tube; and the rear end of a pool cue stick section extends outward to the rear of the pool cue stick section straightener protective holder.

9. The pool cue stick section straightener and protective holder of claim 8, wherein adhesive applied to the inner side of the forward end of the cylindrical shaped relatively stiff material holds the forward end of a cloth strip in place; and adhesive applied to the inner rear surface of said tube holds the rear ends of a cloth strip in place.

10. The pool cue stick section straightener and protective holder of claim 9, wherein said insert plug is a plastic cup shaped plug press fitted in the forward end of said tube.

11. The pool cue stick section straightner and protective holder of claim 9, wherein said insert plug is a plastic cup shaped plug fixed in place in the front end of said tube by adhesive.

12. The pool cue stick section straightener and protective holder of claim 9, wherein said cylindrical shaped relatively stiff material is a cylinder of relatively stiff paper having an attractive outer facing side design.

* * * * *